United States Patent [19]

Yamashita

[11] 4,347,095

[45] Aug. 31, 1982

[54] ADHESIVE APPLICATOR

[76] Inventor: Kyoichi Yamashita, 2361 Nippa-cho, Kohoku-ku, Yokohama-shi, Kanegawa 223, Japan

[21] Appl. No.: 225,547

[22] Filed: Jan. 16, 1981

[30] Foreign Application Priority Data

Jan. 16, 1980 [JP] Japan ..... 55-2629

[51] Int. Cl.[3] ..... B05C 1/00

[52] U.S. Cl. ..... 156/578; 118/221; 118/258; 118/261

[58] Field of Search ..... 118/261, 259, 262, 221, 118/258; 156/578

[56] References Cited

U.S. PATENT DOCUMENTS

| | | | |
|---|---|---|---|
| 1,716,072 | 6/1929 | MacCubbin | 118/221 |
| 2,327,525 | 8/1943 | Hopkins | 118/221 X |
| 2,330,830 | 10/1943 | Malhoit | 118/221 X |
| 3,294,060 | 12/1966 | McIntyre | 118/261 |
| 3,379,171 | 4/1968 | Cordingly et al. | 118/261 |

*Primary Examiner*—David A. Simmons

*Attorney, Agent, or Firm*—Armstrong, Nikaido, Marmelstein & Kubovcik

[57] ABSTRACT

An apparatus for supplying an adhesive to a cylindrical drum rotatable about a vertical axis for applying the adhesive to labels, which comprises a housing disposed in close contact with the drum and having a curved wall extending parallel and adjacent to the circumference of the drum. First and second compartments are defined in the housing, juxtaposed downstream and upstream with respect to the direction of rotation of the drum, and exposed to the drum through openings in the curved wall. Also an upper compartment is defined in the housing over the first and second compartments. A passage communicates the upper compartment to the first compartment, and drain pipes communicate the first and second compartments to the upper compartment. The intersections between the downstream side walls of the first and second compartments and the curved wall form vertically extending scraping edges, and the drain pipes are substantially aligned with the scraping edges.

7 Claims, 6 Drawing Figures

ADHESIVE APPLICATOR

BACKGROUND OF THE INVENTION

This invention relates to adhesive applicators and, more particularly, to apparatus for supplying an adhesive to an applicator drum.

Many applicators are known and available for applying an adhesive to labels, seals or the like. The adhesive is fed to an applicator drum by means of a spray or doctor coater or the like before it is transferred to labels. Usually the amount of adhesive supplied to the applicator drum is larger than that just required for the labels. An excess of the adhesive drips off of the drum, is collected in a sump and fed back to a supply source for recirculation. In such cycles, the adhesive is susceptible to deterioration due to repeated heating and air inclusion as well as to contamination.

SUMMARY OF THE INVENTION

It is, therefore, desired to eliminate these and other shortcomings associated with conventional adhesive applicators.

An object of the present invention is to provide an adhesive supply apparatus by which a minimum requisite amount of adhesive is supplied to the surface of an applicator drum to minimize the dropping of excess adhesive.

Another object of the present invention is to provide an adhesive supply apparatus in which the amount of air bubbles included in the circulated adhesive is reduced upon recovery to prevent the adhesive from deteriorating.

According to the present invention, there is provided an apparatus for supplying an adhesive to a cylindrical drum rotatable about a vertical axis for applying the adhesive to labels, which comprises a housing disposed in close contact with the drum and having a curved wall extending parallel and adjacent to the circumference of the drum. First and second compartments are defined in the housing, juxtaposed downstream and upstream with respect to the direction of rotation of the drum, and exposed to the drum through openings in the curved wall. Also an upper compartment is defined in the housing over the first and second compartments. A passage communicates the upper compartment to the first compartment, and drain pipes communicate the first and second compartments to the upper compartment. The intersections between the downstream side walls of the first and second compartments and the curved wall form vertically extending scraping edges, and the drain pipes are substantially aligned with the scraping edges.

BRIEF DESCRIPTION OF THE DRAWINGS

The above and other objects, features and advantages of the present invention will be more readily understood from the following description with reference to the accompanying drawings, in which.

DESCRIPTION OF THE PREFERRED EMBODIMENTS

Figure 6:
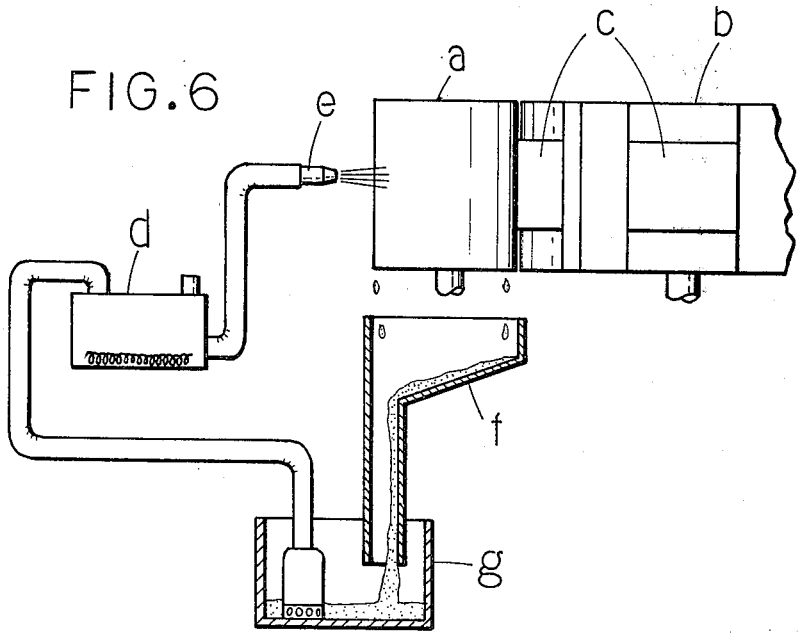
FIG. 6 is a schematic illustration of a prior art adhesive applicator.

First referring to FIG. 6, a typical prior art apparatus for applying an adhesive to the back of successively fed labels or seals is schematically shown. The adhesive application apparatus comprises an adhesive applying or spreading drum a disposed in close contact with another drum b for carrying labels c thereon to pass the labels along the circumference of the adhesive applying drum. The apparatus also includes an accumulator d in which a hot-melt adhesive is not only melted, but also pumped therefrom under pressure, and a spray gun e connected to the outlet of the accumulator d for spraying the adhesive onto the applicator drum a.

Since the amount of adhesive sprayed is maintained constant, an excess of the adhesive will drop down from the applicator drum a, particularly when the drum rotates at a relatively low speed. Drips of the excess adhesive are received by a hopper f and then collected in a sump g. The adhesive collected in the sump g is pumped back to the accumulator d.

In this manner, a relatively large amount of adhesive fluid is recirculated. The adhesive tends to be deteriorated by repeated heating, as well as being contaminated with foreign matter after several cycles. In addition, a plurality of air bubbles may be included into the adhesive fluid during the recovering step and such air inclusion may also deteriorate the adhesive.

Figure 1:
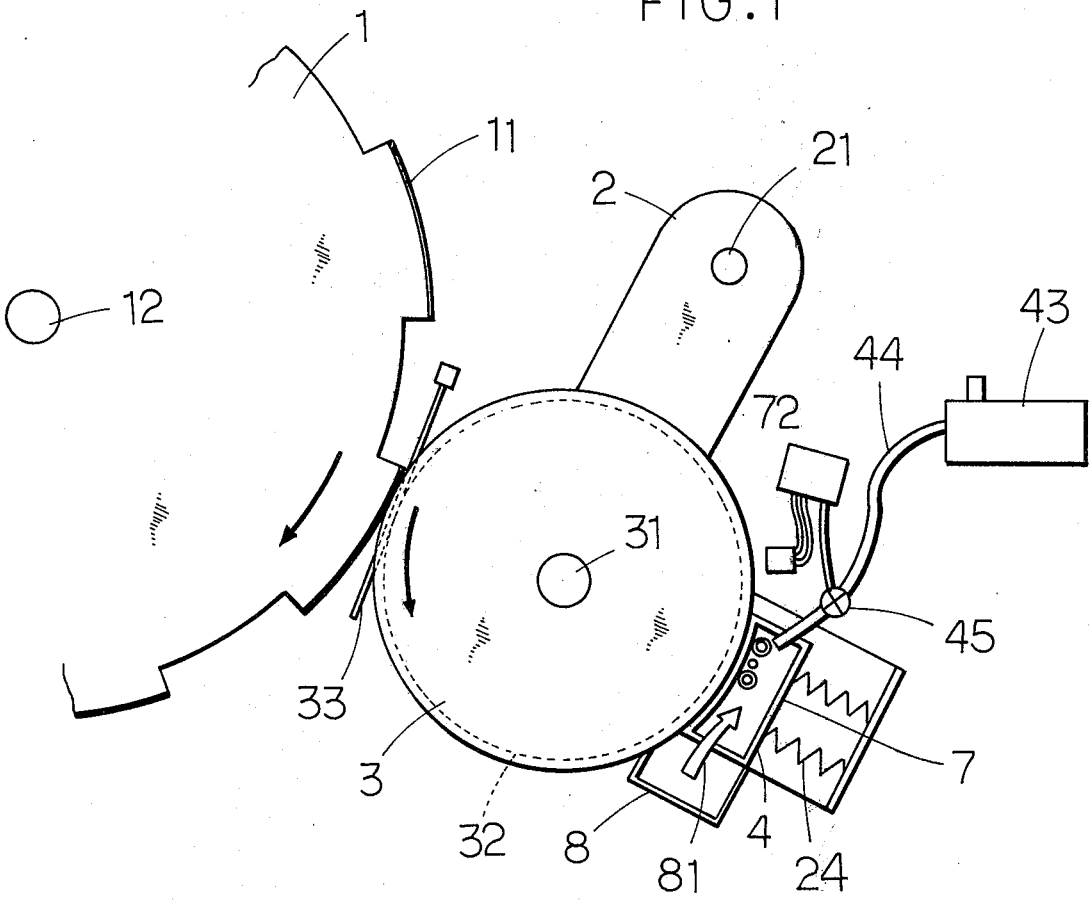
FIG. 1 is a plan view of the adhesive supply apparatus of the present invention in combination with an applicator drum and a label carrying drum.

Referring to FIG. 1, an adhesive supply apparatus according to the present invention is illustrated in combination with a drum 1 for carrying labels 11 with their back sides exposed by holding the labels on the drum by vacuum suction. The label-carrying drum 1 rotates about a vertical shaft 12. Disposed in close contact with the label-carrying drum 1 is an applicator drum 3 which rotates about a vertical shaft 31 extending parallel to the shaft 12. As the label-carrying drum 1 rotates, labels 11 are brought into contact with the applicator drum 3 and have adhesive applied on their back sides.

The shaft 31 of the applicator drum 3 is mounted on an L-shaped support plate 2, which is pivotally mounted on a vertical pivot 21. The support plate 2 may be swung a small angle about the pivot 21 so that the applicator drum 3 is spaced apart the label-carrying drum 1 when it is desired to maintain the applicator drum 3 spaced apart from the label-carrying drum 1 for a long period after the interruption of application.

Figure 3:
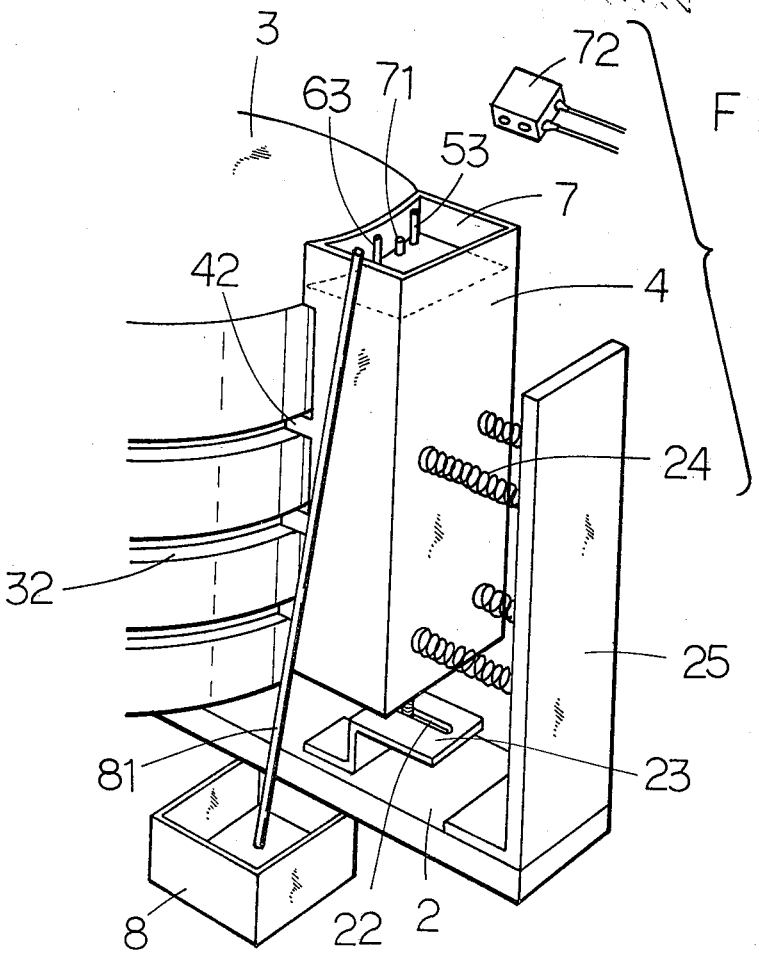
FIG. 3 is a perspective view of the container of FIG. 2 taken from the opposite side.

Disposed in close contact with the applicator drum 3 at the side substantially opposite to its contact with the label-carrying drum 1 is an adhesive supply container 4. The container 4 is supported for adjustment by suitable retaining means, for example, a bolt extending downward from the bottom of the container and fitted in a slot 22 in a bracket 23 secured to the L-shaped support plate 2 as shown in FIG. 3. The wall of the container 4 opposite to the applicator drum 3 is supported by a plurality of springs 24 secured to an upstanding bracket 25 on the support plate 2. The container 4 is vertically supported by the bolt-and-slot combination and horizontally urged against the circumference of the applicator drum 3 by the springs 24.

A separately mounted accumulator 43 supplies molten adhesive to the container 4 through a conduit 44 which is heated by suitable heating means.

Figure 2:
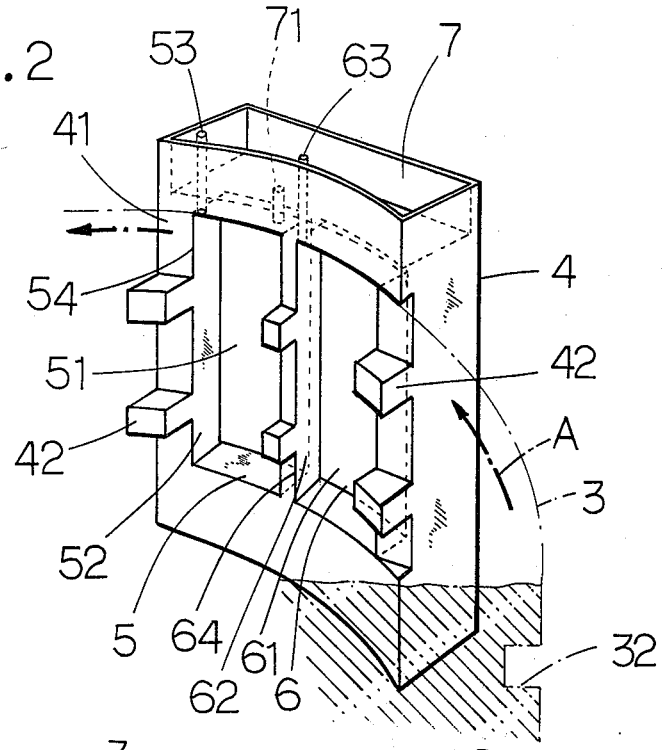
FIG. 2 is a perspective view of a container of the supply apparatus taken from the applicator drum side.
Figure 4:
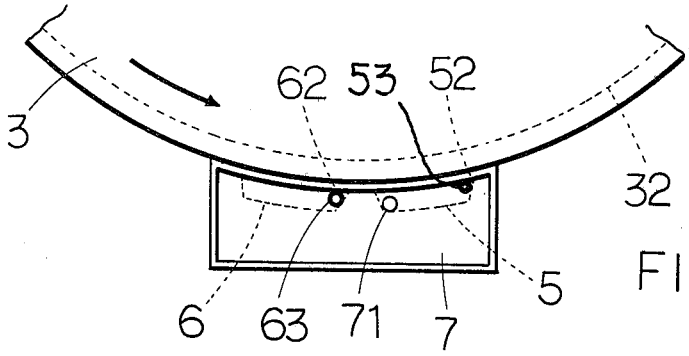
FIG. 4 is an enlarged plan view of the container.

The structure of the wall of the container 4 which faces the applicator drum 3 is illustrated in a perspective view of FIG. 2. The wall 41 of the container 4 is disposed in contact with the applicator drum 3 and has the same curvature as the drum 3. The wall 41 is provided with two openings juxtaposed in a circumferential direction. The container 4 includes first and second compartments 5 and 6 circumferentially separated from each other by a partition and located downstream and upstream with respect to the direction of rotation of the applicator drum 3 shown by arrow A. The first (or downstream) and second (or upstream) compartments 5 and 6 have a height shorter than the axial width of the drum 3. As best seen from FIGS. 2 and 4 of the first or downstream compartment 5 is defined by a back wall 51 extending substantially parallel to the curved wall surface and side walls 52 diverging from either edge of the back wall. The angle formed between the back wall 51 and the side walls 52 is greater than 90°. Similarly, the second or upstream compartment 6 is defined by a curved back wall 61 and diverging side walls 62. Likewise, the angle between back wall 61 and side walls 62 is also greater than 90°.

The container 4 also includes an upper compartment 7 extending over both the first and second compartments and 5 and 6 and separated therefrom by a partition. A hole 71 is formed in the partition between the upper and first compartments 7 and 5 for the passage of adhesive fluid therebetween.

The first and second compartments 5 and 6 are also provided at the top with drain pipes 53 and 63 extending vertically upward and opening at a sufficient height in the upper compartment 7. The drain pipes 53 and 63 are located at the most downstream end of the compartments 5 and 6 with respect to the drum rotation direction A.

In a preferred embodiment, the applicator drum 3 at the circumference is provided with one or more (for example, three in FIG. 3 and two in FIG. 5) channels 32 extending in a circumferential direction. The channels 32 are formed for the purpose of preventing the transfer of labels 11 to the applicator drum 3 because labels on the carrying drum 1 are otherwise intercepted by the applicator drum 3 when the adhesive force between the labels and the applicator drum 3 is higher than the suction force by the carrying drum 1. To this end, interfering or separating bars 33 made, for example, of piano wire, are horizontally extended in the channels 32 between the carrying drum 1 and the applicator drum 3 as shown in FIG. 1.

Those portions of the curved wall 41 of the container 4 which correspond to the upstream side wall of the container, the partition between the first and second compartments 5 and 6, and the downstream side wall of the container are provided with plural sets of projections 42 in alignment with the channels 32 in the drum 3. The projections 42 and the remaining surface areas of the curved wall 41 are in close sliding fit with the channels 32 and the circumferential surface areas of the drum 3. Differently stated, the first and second compartments 5 and 6 are substantially closed by the circumference of the drum 3 through the meshing of the projections 42 with the channels 32.

In another preferred embodiment of the present invention, detection means is provided for sensing the level of adhesive fluid in the upper compartment 7 of the container 4. For example, a reflection plate may be attached to the side wall of the upper compartment 7 and a photoelectric detector 72 may be provided above the container 4 as shown in FIGS. 1 and 3. When the adhesive fluid in the upper compartment 7 increases to above the reflection plate, the detector 72 senses no reflected light. Alternatively, a float may be used to determine the level of the adhesive fluid in the upper compartment. Other liquid level detectors may occur to those skilled in the art. The detector 72 may be electrically connected to an electromagnetic valve 45 in the conduit 44 extending from the accumulator 43. With this arrangement, fresh molten adhesive is dispensed from the accumulator 43 to the container upper compartment 7 whenever the amount of adhesive decreases below a predetermined level.

In a further preferred embodiment of the present invention, recovering means is provided for recovering an excess amount of adhesive. Although the amount of adhesive applied to the surface of the drum 3 is optimized according to the present invention, there still remains the possibility that a small excess amount of the adhesive drops from the applicator drum 3. A sump 8 is disposed below the container 4 to receive drips of the excess adhesive. A suitable feed-back means 81 may be provided between the sump 8 and the container upper compartment 7 for the recovery of the collected adhesive. Use may be made of a pump combined with a piping or a screw conveyor consisting of a piping having a screw built in.

The operation of the above-described adhesive supply apparatus is described below:

I. APPLICATION OF MOLTEN ADHESIVE

A molten adhesive is pumped by the accumulator 43 to the upper compartment 7 of the container 4 through the heated conduit 44. The adhesive in the upper compartment flows into the first or downstream compartment 5 through the passage 71 so that the compartment 5 is fully filled with the adhesive.

The molten adhesive in the first compartment 5 is in constant contact with a portion of the circumferential surface of the applicator drum 3 defined by the first opening. As the applicator drum 3 rotates, the adhesive is applied to the entire circumferential surface of the drum. The adhesive on the applicator drum is successively transferred to labels 11 as the carrying drum 1 brings the labels into contact with the adhesive applied surface of the applicator drum 3. During the adhesive transfer contact, the separating bars 33 prevent the labels from being released from the carrying drum 1 due to the adhesive force.

In applying the adhesive in the first compartment 5 to the applicator drum surface, an intersection 54 between the downstream side wall 52 and the most downstream area of the curved wall 41 forms a first scraping edge. A gap is defined between the drum surface and the first scraping edge 54 and maintained at a given distance by the position adjusting means in the form of the springs 24 such that an optimum amount of the adhesive is uniformly applied to the drum surface and the remaining portion of the adhesive entrained by the moving drum surface is scraped by this first scraping edge 54.

Figure 5:
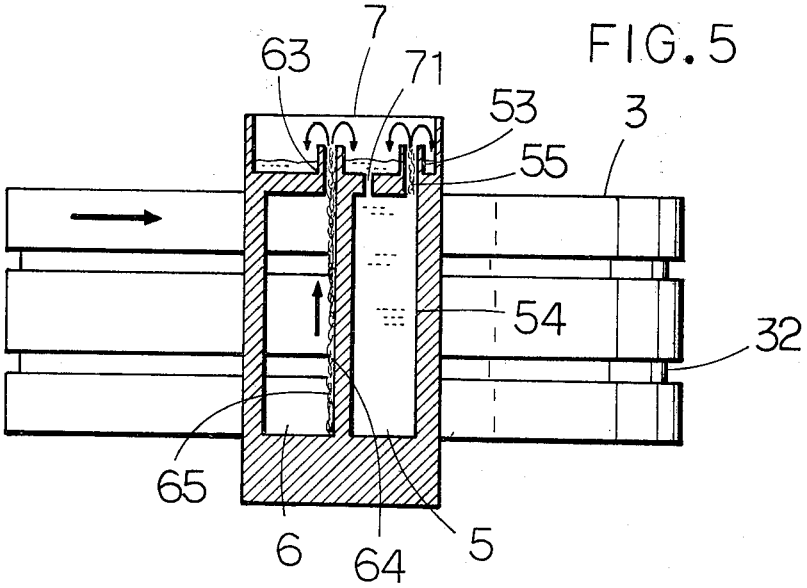
FIG. 5 is a vertical cross-section of the container.

The excess portion of the adhesive thus scraped forcedly moves upward along the first scraping edge 54 to form a column 55 of the adhesive which grows vertically upward through the drain pipe 53 aligned with the first scraping edge 54 and flows into the upper compartment 7 as shown in FIG. 5.

When the scraped adhesive, like a column, moves out of the drain pipe 53, air bubbles included therein tend to escape from the adhesive. As a result, the inclusion of air bubbles is minimized in the recovered adhesive. The adhesive thus recovered in the upper compartment 7 flows into the first compartment 5 and follows the same routes as described above.

II. RECOVERY OF EXCESS ADHESIVE

If the amount of adhesive transferred to labels is smaller than the amount of adhesive applied to the surface of the drum 3, then a non-transferred or excess portion of adhesive is carried as such into the second compartment 6 as the drum 3 rotates. an intersection 64 between the downstream side wall 62 of the second compartment 6 and the intermediate partition-forming area of the curved wall 41 forms a second scraping edge. The non-transferred or excess adhesive portion is scraped by this second scraping edge 64 and forcedly moves upward along the edge to form a column 65 of the adhesive which grows vertically upward through the drain pipe 63 and flows into the upper compartment 7 as in the case of the first compartment 5. Air bubbles included also escape from the adhesive during this draining.

The adhesive supply apparatus thus constructed and operated according to the present invention has many advantages. One of the most important advantages is to regulate the amount of adhesive applied to the drum surface by means of the first scraping edge 54 of the first compartment 5. The function of the scraping edge 54 is unique and different from that of the so-called "doctor blade" commonly used in conventional applicators. The scraping edge 54 cooperates with the rotating drum surface so as to forcedly move the excess adhesive upward. The excess adhesive continuously moves upward through the drain pipe 53 in the form of a column and collects in the upper compartment for recirculation while air bubbles are released.

The scraping edge 64 of the second compartment 6 has the same function as the first scraping edge 54. Consequently, the excess portions of the adhesive are circulated with a relatively short period of time without passing through the accumulator again as in the case of the prior art. The adhesive thus recovered only deteriorates a minimum extent. The adhesive is consumed while it is fresh.

What is claimed:

1. An apparatus for supplying an adhesive to a cylindrical drum rotatable about a vertical axis for applying the adhesive to an object, the apparatus comprising:

a container disposed in close contact with the drum and having a curved wall extending parallel and adjacent to the circumference of said drum;

first and second compartments defined in said container, juxtaposed downstream and upstream with respect to the direction of rotation of said drum, and exposed to said drum through openings in said curved wall, the downstream side walls of the first and second compartments intersecting with the curved wall to define scraping edges, respectively;

an upper compartment defined in said container over said first and second compartments;

a passage communicating the upper and first compartments; and drain pipes substantially aligned with said scraping edges and communicating the first and second compartments to the upper compartment, respectively.

2. An apparatus as set forth in claim 1 wherein said scraping edges extend vertically.

3. An apparatus as set forth in claim 1 wherein said drain pipes extend into the upper compartment above the bottom thereof.

4. An apparatus as set forth in claim 1 wherein said first and second compartments have a height not more than the vertical width of said drum.

5. An apparatus as set forth in claim 1 which further includes resilient means disposed between a fixed base and said container for urging said container against the surface of said drum.

6. An apparatus as set forth in claim 5 wherein said resilient means comprises at least one spring.

7. An apparatus as set forth in claim 1 wherein said drum is provided with at least one circumferential channel, and the curved wall of said container is provided with a least one set of projections which closely mesh with said channel for circumferential sliding motion.

* * * * *